US007484804B2

(12) United States Patent
Clauss

(10) Patent No.: US 7,484,804 B2
(45) Date of Patent: Feb. 3, 2009

(54) FOLDING SEAT HAVING A MOVING SEAT PROPER AND A MOVING SEAT BACK

(75) Inventor: Philippe Clauss, Semouse (FR)

(73) Assignee: Delagrave S.A., Paris (FR)

( * ) Notice: Subject to any disclaimer, the term of this patent is extended or adjusted under 35 U.S.C. 154(b) by 4 days.

(21) Appl. No.: 11/386,089

(22) Filed: Mar. 22, 2006

(65) Prior Publication Data

US 2006/0214488 A1 Sep. 28, 2006

(30) Foreign Application Priority Data

Mar. 22, 2005 (FR) ..... 05 02826
Jan. 12, 2006 (FR) ..... 06 00276

(51) Int. Cl.
*A47C 1/00* (2006.01)
*A47C 9/06* (2006.01)

(52) U.S. Cl. ..... 297/334; 297/335; 297/14

(58) Field of Classification Search ..... 297/14, 297/37, 38, 335, 334, 331, 332
See application file for complete search history.

(56) References Cited

U.S. PATENT DOCUMENTS 141,456 A * 8/1873 Nolan ..... 297/335
141,457 A * 8/1873 Nolan ..... 297/331
820,344 A * 5/1906 Brierley ..... 297/184.15
1,239,185 A * 9/1917 Hunt ..... 297/334
1,412,367 A * 4/1922 Noack ..... 297/324
1,685,137 A * 9/1928 Randall ..... 248/240.4
3,594,037 A * 7/1971 Sherman ..... 297/14
3,656,806 A 4/1972 Castellli et al.
4,902,069 A * 2/1990 Lehnert ..... 297/14
5,498,062 A * 3/1996 Holdampf ..... 297/238
5,588,700 A * 12/1996 Homier ..... 297/238
5,918,937 A * 7/1999 Moffa et al. ..... 297/324

FOREIGN PATENT DOCUMENTS

FR 26668050 4/1992
FR 2 790 927 9/2000
GB 510 187 A 7/1939

OTHER PUBLICATIONS

French Search Report dated Nov. 28, 2005.

* cited by examiner

*Primary Examiner*—Sarah B McPartlin
(74) *Attorney, Agent, or Firm*—Blank Rome LLP

(57) ABSTRACT

A folding seat including a hinge device mounted on a stand. The seat back and the seat proper are moveable manually between folded-away position in which they are disposed parallel one against the other, and an in-use position. The hinge device is arranged so that moving the seat proper towards its in-use position causes the seat back to move upwards and to be inclined rearwards so as to dispose the seat in its in-use position.

15 Claims, 5 Drawing Sheets

Figure I

FOLDING SEAT HAVING A MOVING SEAT PROPER AND A MOVING SEAT BACK

BACKGROUND OF THE INVENTION

1. Field of the Invention

The invention relates to a folding seat designed to equip rooms and halls receiving the public (amphitheaters, cinema theaters, auditoriums, venues, conference halls, theaters, etc.).

2. Descripiton of the Related Art

In the prior art, seats are known in which the seat proper is mounted to move between a substantially horizontal in-use position and a folded-away position in order to limit the amount of space occupied by the seat while it is not being used. Thus, the movability of the seat proper makes it possible to satisfy normative and/or dimensional constraints related to rooms and halls receiving the public.

In particular, seats are known in which the seat proper is a moving part while the seat back is stationary and inclined rearwards in order to increase user comfort. However, the inclining of the seat back increases the amount of space occupied by the seat when it is in its folded-away position. Seats also exists in which the seat proper is a moving part while the seat back is stationary and perpendicular to the floor. However, compactness is improved to the detriment of user comfort.

SUMMARY OF THE INVENTION

An object of the invention is to remedy those problems by proposing a folding seat that has a seat proper inclined rearwards when in its in-use position so as to increase user comfort and that is as compact as possible when in its folded-away position.

Another object of the invention is to propose a seat whose seat back and whose seat proper can be moved manually and simply.

To these ends, in a first aspect, the invention provides a folding seat comprising a seat proper, a seat back, and a hinge device mounted on a stand, said seat back and said seat proper being moveable manually between a folded-away position in which they are disposed parallel one against the other, and an in-use position, said seat being characterized in that the device comprises:

- a first link secured to the seat proper and mounted to pivot relative to the stand and to the seat back respectively about a first pivot axis and about a second pivot axis;
- a second link mounted to pivot relative to the stand and to the seat back respectively about a third pivot axis and about a fourth pivot axis;

the four pivot axes forming a deformable quadrilateral arranged so that moving the seat proper towards its in-use position causes the seat back to move upwards and to be inclined rearwards so as to dispose the seat in its in-use position.

Thus, the seat back is inclined in its in-use position, and the seat is as compact as possible in its folded-away position. The seat back and the seat proper are disposed parallel one against the other in the folded-away position, thereby making it possible to maximize the compactness of the seat.

The invention also provides a seat in which the seat back and the seat proper are moved manually and whose equilibrium position is the folded-away position.

BRIEF DESCRIPTION OF THE DRAWINGS

Other objects and advantages of the invention appear from the following description given with reference to the accompanying drawings, in which.

DETAILED DESCRIPTION ON THE INVENTION

Figure 1:
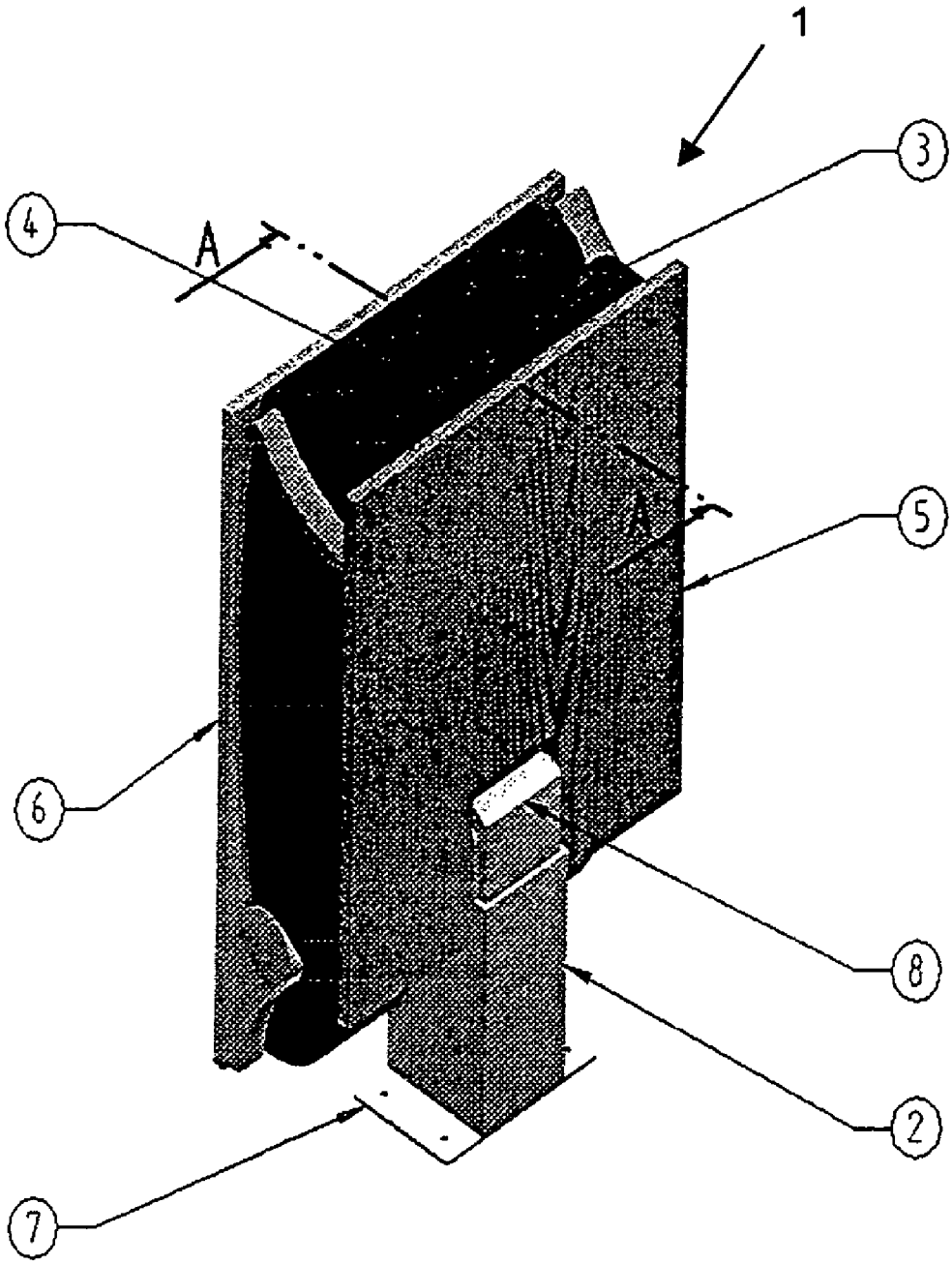
FIG. 1 shows a first embodiment of the folding seat of the invention in its folded-away position.
Figure 2:
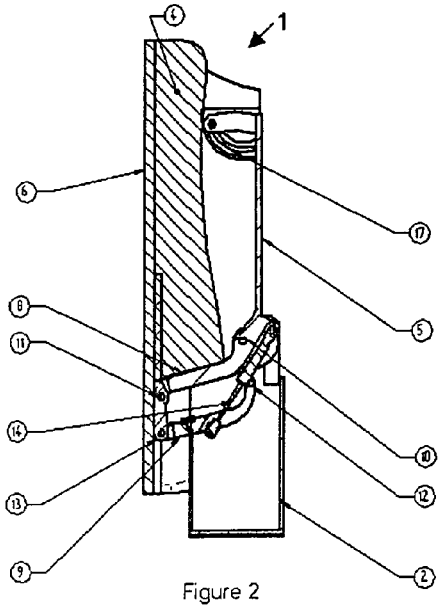
FIG. 2 is a side view of the seat of FIG. 1 in section on A-A'.
Figure 3:
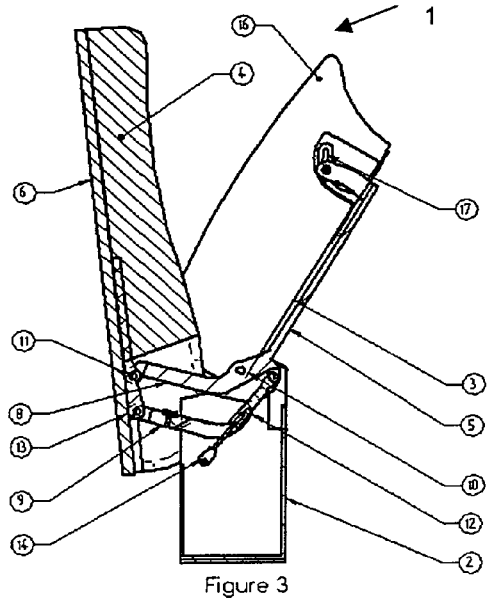
FIGS. 3 and 4 are side views of the seat of FIG. 1 in section on A-A' while the seat proper and the seat back are being moved manually between a folded-away position and an in-use position, respectively 25% opened and 75% opened.
Figure 4:
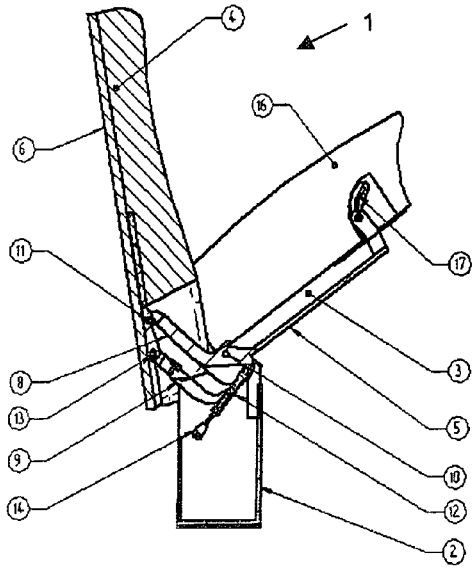
Figure 5:
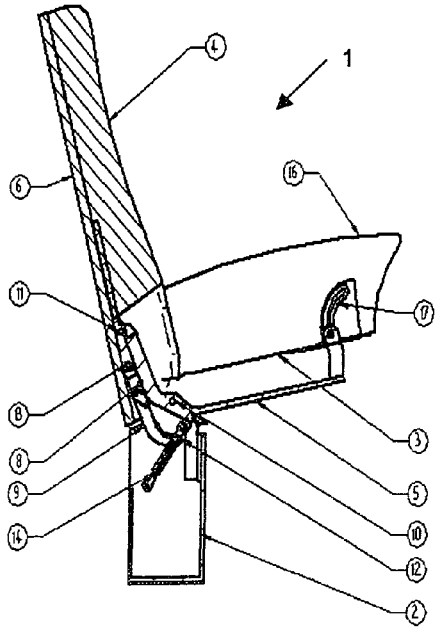
FIG. 5 is a side view of the seat of FIG. 1 in the in-use position in section on A-A'.

The folding seat 1 shown in. FIG. 1 has a stand 2, a seat proper 3, and a seat back 4.

The stand 2 supports a hinge device for hinging the seat. The hinge device comprises a first rigid plate 5 and a second rigid plate 6 making it possible respectively to secure the seat proper 3 to the hinge device and to secure the seat back 4 to the hinge device.

The seat back 4 and the seat proper 3 are movable manually between a folded-away position in which they are disposed parallel one against the other, and an in-use position.

The stable position of the seat 1 is its folded-away position. In order to move the seat manually from the folded-away position to the in-use position, the user presses on the seat proper 3 in order to cause it to pivot relative to the stand 2. During this movement, the hinge device also causes the seat back 4 to move.

The hinge device further comprises two links 8, 9. The links 8, 9 make it possible to mount the seat back 4, the seat proper 3, and hinge device on the stand 2.

The first link 8 is secured to the seat proper 3 and is mounted to pivot relative to the stand 2 and to the seat back 4 respectively about a first pivot axis 10 and about a second pivot axis 11. The second link 9 is mounted to pivot relative to the stand 2 and to the seat back 4 respectively about a third pivot axis 12 and about a fourth pivot axis 13.

To this end, the first link 8 and the second link 9 are mounted to pivot firstly on the stand 2 and secondly on the second rigid plate 6.

The four pivot axes 10, 11, 12, and 13 form a deformable quadrilateral. Thus, moving the seat proper 3 towards its in-use position causes the seat back 4 to moved upwards and rearwards so as to dispose the seat 1 in its in-use position.

In a particular embodiment of the invention, the deformable quadrilateral is a parallelogram.

In a first embodiment shown in FIGS. 1 to 6, the stand 2 has a base 7 provided with orifices making it possible to insert fastener members such as bolts for fastening the stand 2 to the floor.

In an embodiment of the invention, the stand 2 is hollow and it encloses a gas actuator 14 having one end mounted to pivot on the stand and the other end mounted to pivot on the seat proper 3 or on the hinge device as described in Patent Document FR 2 790 927. The use of such an actuator 14 makes it possible to slow down the movement of the seat proper 3 and of the seat back 4 as they are moving towards their folded-away position.

When the user ceases to exert pressure on the seat proper 3, the weight of the seat back 4 causes the seat back and the seat proper to return towards their folded-away position. The gas expanding in the actuator 14 makes it possible to slow down the movement of the seat back and of the seat proper towards their folded-away position effectively an silently. The seat proper 3 and the seat back 4 thus move at constant and controlled speed.

In a preferred embodiment, the actuator 14 that is used is a dynamic actuator making it possible to brake the movement of the seat back and of the seat proper over their entire strokes.

In the first embodiment shown in FIGS. 1 to 6, the seat 1 has two armrests 15, 16. The armrests 15, 16 are mounted to pivot relative to the seat back 4. The armrests 15, 16 are mounted to move between a deployed position and folded-away position.

In an embodiment, the armrests 15, 16 are also secured to the seat proper 3. Thus, moving the seat proper 3 towards its in-use position makes it possible to deploy the armrests 15, 16, and moving the seat proper 5 towards its folded-away position causes the armrests 15, 16 to be folded away.

In the embodiment shown, curved slideways 17 are disposed in the armrests 15, 16. Fingers secured to or integral with the seat proper are mounted to move in said slideways 17.

When the armrests 15, 16 are in their folded-away-position, the moving fingers are situated in the top portions of the slideways 17. While the seat back is moving towards its in-use position, the moving fingers slide in the slideways 17 so as to come into abutment against the ends of the bottom portions of the slideways 17.

Thus, the armrests 15, 16 are secured to the seat proper 3 so that the distance between the armrests 15, 16 and the seat proper 3 varies while they are moving respectively.

Figure 6:
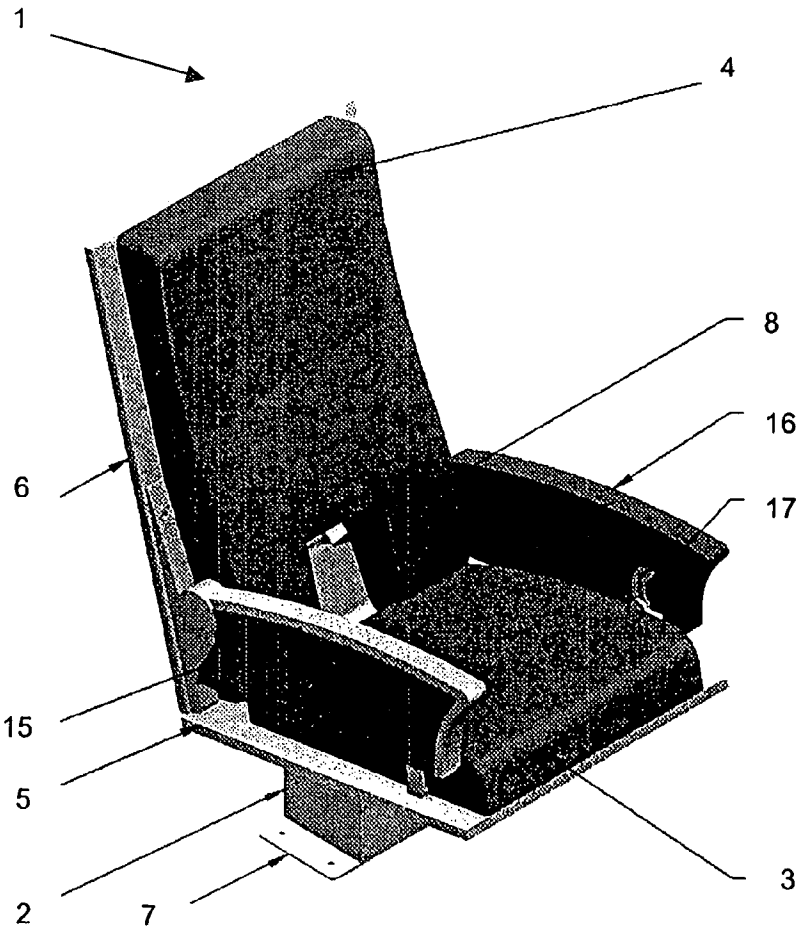
FIG. 6 shows the first embodiment of the seat in its in-use position.

Therefore, as shown in FIGS. 1 and 6, the armrests 15, 16 are disposed against the second rigid plate 6, in their folded-away position, when the seat is in its folded-away position, in order to limit the amount of space occupied by the seat, and the armrests 15, 16 are spaced apart from the seat proper 3, when they are in their deployed position, when the seat is in its in-use position.

It should be noted that, in the embodiment shown in FIGS. 1 to 6, the seat back 4 and the seat proper 3 do not extend over the entire surfaces of the rigid plates 5, 6 in order to provide space for the armrests 15, 16 when the seat is folded away.

In a preferred embodiment of the invention, the seat back 4 has a shape that is substantially complementary to the seat proper 3 in order to reduce the thickness of the seat 1 when said seat is in its folded-away position.

As is known to the person skilled in the art, the stand 2 has an abutment making it possible to define an end position for the seat proper 3, and therefore for the seat back 4, when the seat 1 is in its in-use position.

Figure 7:
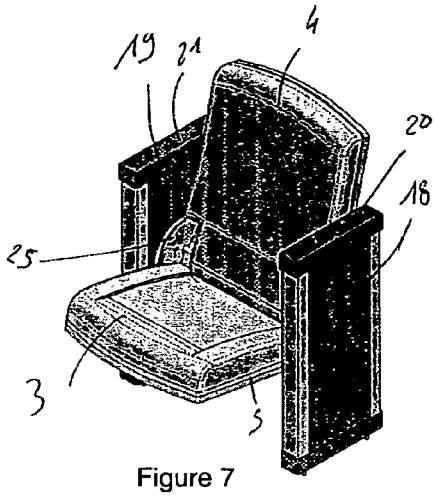
FIG. 7 shows a second embodiment of the seat of the invention in the in-use position.
Figure 8:
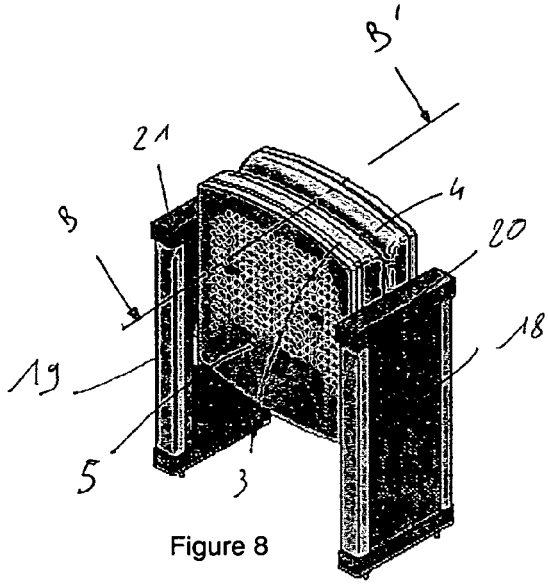
FIG. 8 shows the second embodiment of the seat of the invention in its folded-away position.
Figure 9:
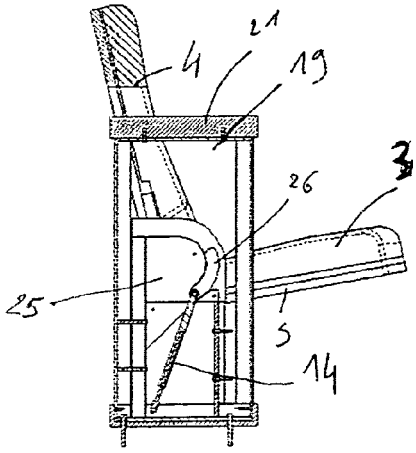
FIG. 9 is a side view of the seat in the in-use position.
Figure 10:
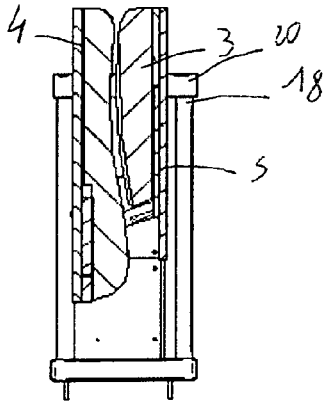
FIG. 10 is a side view in section on the axis B-B' of FIG. 8.
Figure 11:
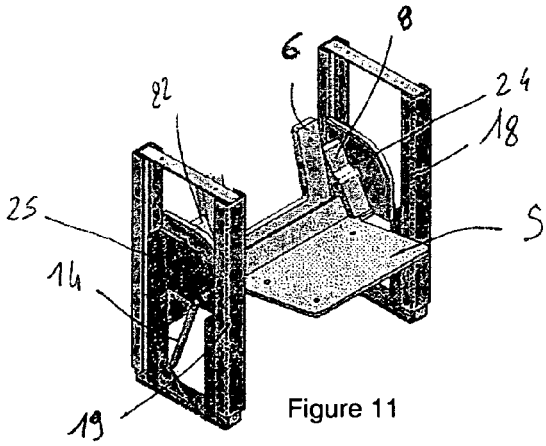
FIG. 11 shows the stand and the hinge device of the second embodiment of the seat of the invention.
Figure 12:
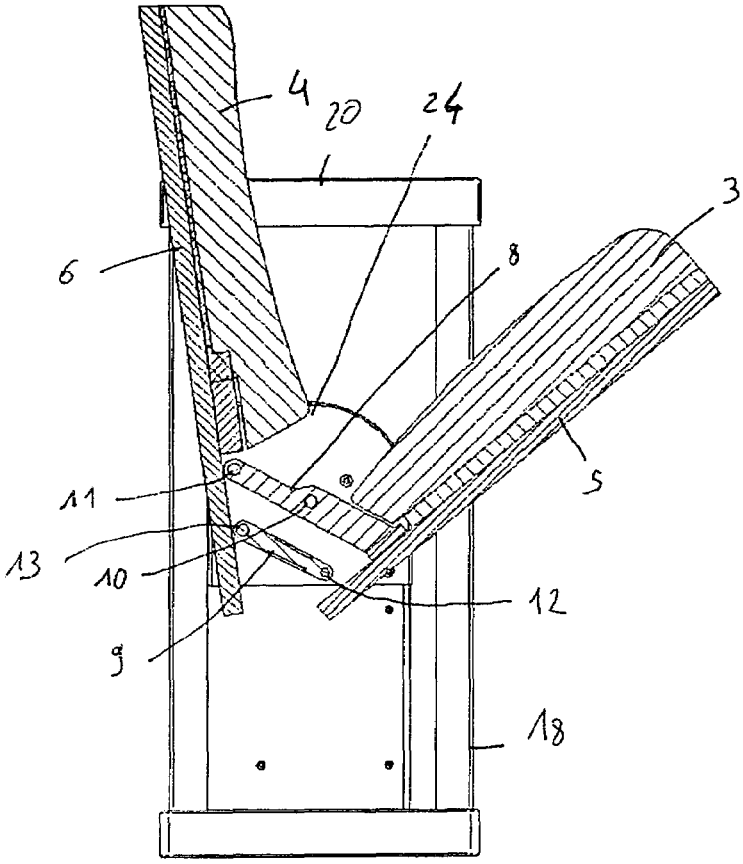
FIG. 12 is a section view of the second embodiment of the seat.

In a second embodiment of the invention, shown in FIGS. 7 to 9, the stand 2 is made up of a first side element 18 and of a second side element 19, which elements are disposed on either side of the seat proper and of the seat back. Each element 18, 19 has fastener means for fastening to the floor.

The side elements 18, 19 are arranged to form armrests when said seat is in its in-use position. To this end, each side element 18, 19 is equipped with an armrest pad 20, 21 disposed on the top end of said side element. The armrest pads 20, 21 are preferably made of foam. The height of the side elements 20, 21 is adjusted to impart maximum comfort to the user.

In the embodiment shown, each of the side elements 18, 19 comprise section members assembled together to form a frame. The frame is then covered with fabric and/or with foam.

The first link 8 and the second link 9 are firstly mounted to pivot on a first side element 18 and secondly mounted to pivot relative to the seat back 4 via the second rigid plate 6. As in the preceding embodiment, the first link 8 is secured to the first rigid plate 5 and therefore to the seat proper 3.

A third link 22 is parallel to the first link 8, and is secured to the seat proper 3 and mounted to pivot on the second side element 19 about the first pivot axis 10 of the first link 8. In addition, the third link 22 is mounted to pivot on the second rigid plate 6 about the second pivot axis 11 of the first link 8.

A fourth link 23 is parallel to the second link 9 and is mounted to pivot on the second side element 19 about the third pivot axis 12 of the second link 9. In addition, the fourth link 23 is mounted to pivot on the second rigid plate 6 about the fourth pivot axis 13.

In the embodiment shown, the side elements 18, 19 include assembly parts 24, 25 for assembling the links 8, 9, 22, 23 to the side elements 18, 19 disposed on either side of the hinge device and secured to the frames of the side elements 19, 20. The links 8, 9, 22, and 23 are mounted to pivot on said assembly parts 24, 25. The parts 24, 25 form deflectors and thus make it possible to prevent a portion of the body of a user and in particular the fingers of a user from being pinched in the hinge device. For reasons of pleasing appearance, the assembly parts 24, 25 have a broken angle.

Figure 13:
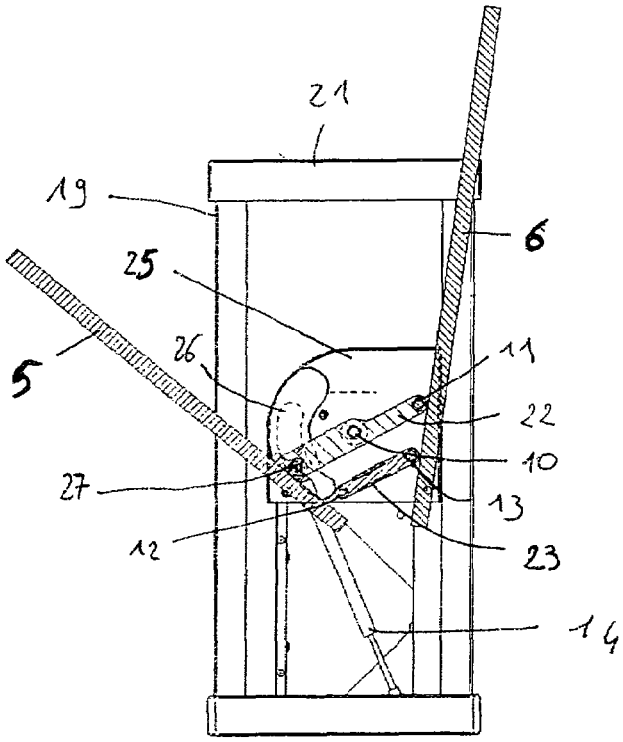
FIG. 13 is a section view of the second embodiment of the armchair.

In the embodiment shown in FIG. 13, an assembly part 25 has a slideway 26. A finger 27 secured to or integral with the seat proper 5 of the seat 1 or secured to or integral with the hinge device is guided in said slideway 26. Thus, the slideway 26 forms an abutment making it possible to define the in-use position and the folded-away position of the seat 1.

As in the preceding embodiment, the stand 2 encloses a gas actuator 14 making it possible to slow down the movement of the seat proper 3 and of the seat back 4 while they are moving towards their folded-away position. The gas actuator 14 has one end mounted to pivot on the first side element 18 or on the second side element 19, and another end mounted to pivot on the seat proper.

In the embodiment shown in FIGS. 9 and 13, the gas actuator 14 has an end mounted to pivot on the finger 27 secured to or integral with the seat proper 3 or secured to or integral with the hinge device.

What is claimed is:

1. A folding seat comprising a seat proper, a seat back, and a hinge device mounted on a stand, said seat back and said seat proper being moveable between a folded-away position, and an in-use position, wherein said seat includes:

a first link secured to the seat proper and mounted to pivot relative to the stand and to the seat back respectively about a first pivot axis located on the stand and about a second pivot axis located on the seat back at a fixed distance from the first pivot axis; and a second link mounted to pivot relative to the stand and to the seat back respectively about a third pivot axis located on the stand and about a fourth pivot axis located on the seat back at a fixed distance from the third pivot axis, wherein the first pivot axis is located a fixed distance from the third pivot axis and the second pivot axis is located a fixed distance from the fourth pivot axis such that the first, second, third, and fourth pivot axes form a deformable quadrilateral with four sides having a fixed length, arranged so that moving the seat proper towards its in-use position causes the seat back to move upwards and to be inclined rearwards so as to dispose the seat in its in-use position.

2. A folding seat according to claim 1, wherein the stand is made up of a first side element and of a second side element, said first and second side elements are disposed on either side of the seat proper and of the seat back.

3. A folding seat according to claim 2, wherein the first link and the second link are mounted to pivot on the first side element, said hinge device further comprising:

a third link secured to the seat proper and mounted to pivot on the second side element and relative to the seat hack respectively about said first pivot axis and about said second pivot axis; and a fourth link mounted to pivot on the second side element and relative to the seat back about said third axis and about said fourth axis.

4. A folding seat according to claim 2, wherein the side elements are arranged to form armrests when said seat is in its in-use position.

5. A folding seat according to claim 3, wherein the side elements include protective assembly parts disposed on either side of the hinge device, the first link and the second link being mounted to pivot on said protective parts.

6. A folding seat according to claim 5, wherein at least one of the protective assembly parts is provided with a slideway for guiding a finger that is coupled with the seat proper or that is coupled with the hinge device so as to form an abutment making it possible to define the in-use position and the folded-away position of said seat.

7. A folding seat according to claim 1, wherein it has armrests mounted to pivot relative to the seat back, said armrests being mounted to move between a deployed position and a folded-away position.

8. A folding seat according to claim 7, wherein the armrests are secured to the seat proper so that moving the seat proper towards its in-use position makes it possible to deploy the armrests, and moving the seat proper towards its folded-away position causes the armrests to be folded away.

9. A folding seat according to claim 8, wherein the armrests are secured in a position at a distance from the seat proper by means of curved slideways which are disposed in the armrests and in which fingers coupled with the seat proper are slidably received so that the distance between the armrests and the seat proper varies while they are moving respectively.

10. A folding seat according to claim 1, wherein the stand encloses a gas actuator having one end that is mounted to pivot on the stand, and another end being mounted to pivot on the seat proper or on the hinge device, said actuator making it possible to slow down movement of the seat proper and of the seat back while they are moving towards their folded-away position.

11. A folding seat according to claim 1, wherein the hinge device comprises rigid plates making it possible to secure the seat back and the seat proper to said hinge device.

12. A folding seat according to claim 1, wherein the seat back has a shape that is substantially complementary to the seat proper in order to enable a reduced thickness of the seat when said seat is in its folded-away position.

13. A folding seat according to claim 1, wherein the deformable quadrilateral formed by the first, second, third, and fourth pivot axes is a parallelogram at both the seat's in-use and folded-away positions.

14. A folding seat comprising:

a seat proper and a seat back being moveable between a folded-away position and an in-use position;

a stand having a first side element and a second side element, said first and second side elements being disposed on either side of the seat proper and the seat back, arranged to form armrests when said seat is in its in-use position, and having protective assembly pads;

a hinge device for moving said seat back and said seat proper between the folded-away position and the in-use position, the hinge device comprising:

a first link secured to the seat proper and mounted to pivot on the protective assembly party of the first side element relative to the seat back respectively about a first pivot axis and about a second pivot axis located a fixed distance from the first pivot axis;

a second link mounted to pivot on the protective assembly part of the first side element and relative to the seat back respectively about a third pivot axis and about a fourth pivot axis located a fixed distance from the third pivot axis;

a third link secured to the seat proper and mounted to pivot on the protective assembly part of the of the second side element and relative to the seat back respectively about said first pivot axis and about said second pivot axis; and a fourth link mounted to pivot on the protective assembly part of the second side element and relative to the seat back about said third axis and about said fourth axis;

wherein the first pivot axis is located a fixed distance from the third pivot axis and the second pivot is axis located a fixed distance from the fourth pivot axis such that the first, second, third, and fourth pivot axes form a deformable quadrilateral with four sides having a fixed length, arranged so that moving the seat proper towards its in-use position causes the seat back to move upwards and to be inclined rearwards so as to dispose the seat in its in-use position, and wherein at least one of the protective assembly pans is provided with a slideway for guiding a finger that is coupled with the seat proper or that is coupled with the hinge device so as to form an abutment making it possible to define the in-use position and the folded-away position of said seat.

15. A folding seat comprising a seat proper, a seat back, and a hinge device mounted on a stand, said seat back and said seat proper being moveable between a folded-away position, and an in-use position, wherein said seat includes:

a first link secured to the seat proper and mounted to pivot relative to the stand and to the seat back respectively about a first pivot axis and about a second pivot axis located a fixed distance from the first pivot axis and;

a second link mounted to pivot relative to the stand and to the seat back respectively about a third pivot axis and about a fourth pivot axis located a fixed distance from the third pivot axis;

wherein the first pivot axis located a fixed distance from the third pivot axis and the second pivot axis located a fixed distance from the fourth pivot axis such that the first, second, third, and fourth pivot axes form a deformable quadrilateral with four sides having a fixed length, arranged so that moving the seat proper towards its in-use position causes the seat back to move upwards and to be inclined rearwards so as to dispose the seat in its in-use position, and wherein the deformable quadrilateral is being a parallelogram at both the seat's in-use and folded-away positions.

* * * * *